United States Patent [19]

Kulka

[11] 4,227,271

[45] Oct. 14, 1980

[54] FOOT SUPPORTING STRAP FOR HOSPITAL BED

[76] Inventor: Thomas S. Kulka, 2108 Payne Ave., Cleveland, Ohio 44114

[21] Appl. No.: 65,151

[22] Filed: Aug. 9, 1979

[51] Int. Cl.[2] ..... A47C 21/00

[52] U.S. Cl. ..... 5/443; 5/508

[58] Field of Search ..... 5/443, 444, 445, 424, 5/508, 503, 504, 505, 506, 507

[56] References Cited

U.S. PATENT DOCUMENTS

| | | | |
|---|---|---|---|
| 908,845 | 1/1909 | Curtin | 5/445 |
| 2,843,858 | 7/1958 | Bjorklund | 5/445 |
| 2,927,329 | 3/1960 | Johannis | 5/445 |
| 3,134,512 | 5/1964 | Sharkey | 5/443 |
| 3,535,719 | 10/1970 | Murcott | 5/424 |
| 3,966,200 | 6/1976 | Kirk | 5/508 |

FOREIGN PATENT DOCUMENTS

| | | | |
|---|---|---|---|
| 74680 | 4/1950 | Denmark | 5/443 |

*Primary Examiner*—Roy D. Frazier
*Assistant Examiner*—Alexander Grosz
*Attorney, Agent, or Firm*—Schwartz, Jeffery, Schwaab, Mack, Blumenthal & Koch

[57] ABSTRACT

A foot supporting strap for beds including a strap having fastening means secured to the ends thereof and to the frame of the bed for detachably mounting the strap to the frame. Means are provided on the underside of the strap for spacing the strap from the mattress whereby in the regions adjacent the spacing means there is formed a space into which the feet of the patient can at least partially extend. The strap thus provides a brace against which the feet of the patient can push to permit movement of the patient to a more comfortable position.

8 Claims, 8 Drawing Figures

FOOT SUPPORTING STRAP FOR HOSPITAL BED

BACKGROUND OF THE INVENTION

The present invention relates as indicated to a foot supporting strap for a hospital bed. The invention is specifically designed to provide substantial footing for patients who are to some degree immobile, with the invention permitting the patient to bring his or her body into a comfortable position and to be retained in such position.

There are known prior art devices for assisting the movement of patients while lying on their back in a hospital bed. U.S. Pat. No. 908,845 to Curtin, for example, discloses a lift strap for a recumbent patient by means of which the patient is able to pull himself up to a sitting position. The device is anchored to a foot post of the bed and can be easily grasped by the patient. Similar devices are disclosed in U.S. Pat. Nos. 2,843,858 and 2,927,329.

U.S. Pat. No. 3,134,592 to Sharkey discloses a foot-restraining excercise device which can be mounted on the foot board of the bed to facilitate patient exercise. However, the device is relatively inflexible in regard to the position thereof relative to the foot boards and the area thereof for accommodating the feet of the patient for excercise purposes.

U.S. Pat. No. 3,535,719 discloses a body restraining device in the form of a band or strap which can extend tightly over the arms and/or legs of the patient, and appropriately tightened. The opposite ends of the band or strap are secured to rails provided at the sides of the support member, which can comprise a stretcher, table or the like. However, once the restraining devices are tightened, it is very difficult for the patient to move his body whereby the patient is oftentimes required to be retained in a position of relative discomfort.

SUMMARY OF THE INVENTION

The present invention comprises a novel foot supporting strap which permits the patient to maintain his body in a comfortable position while lying immobile in bed. The strap can be formed of any suitable material, and is adapted to receive at the opposite ends thereof fastening hooks which can be removably secured to anchoring means mounted on the bed frame. Although a single wedge can be used, a plurality of blocks or wedges are preferred and are secured to the underside of the strap in longitudinally spaced arrangement. The bottom surfaces of the wedges engage the mattress, or the sheets and/or blankets covering the mattress, and thereby position the strap therefrom. Thus, there is provided a space between adjoining wedges and beneath the strap into which the toes of the patient can extend, with the pentration of the feet depending upon the degree to which the strap is tightened relative to the bed frame. In this manner, the strap effectively serves as a brace for the patient thereby permitting him or her to assume the most comfortable position.

A further advantage of the invention is that it readily permits the patient the move his or her body toward the head of the bed, out of uncomfortable positions resulting from the patient sliding toward the foot of the bed. As well understood by those in the art, most hospital beds can be inclined at the top or foot of the bed, or both, and a common bed position is where the top of the bed is inclined so that the upper portion of the body of the patient is raised. This raised position inevitably causes movement of the patient toward the foot of the bed thereby rendering it very difficult for a patient who is immobile to move his body back into a comfortable position. The supporting strap in accordance with the present invention readily permits such movement by manipulation of the feet of the patient, without in any way affecting other parts of the body which are required to be maintained immobile.

These and other objects of the invention will become apparent as the following proceeds, in particular reference to the application drawing.

BRIEF DESCRIPTION OF THE APPLICATION DRAWING

Referring to the application drawing.

DETAILED DESCRIPTION OF THE PREFERRED EMBODIMENTS

Figure 1:
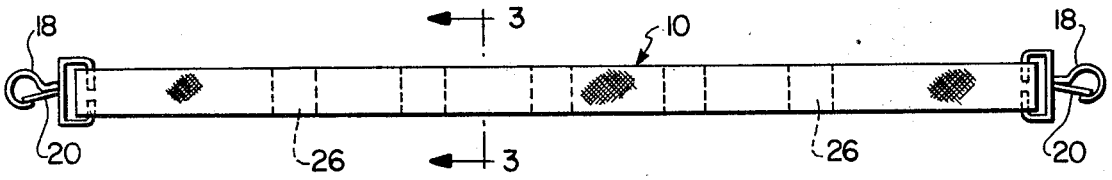
FIG. 1 is a top plan view of the foot supporting strap constructed in accordance with the present invention.
Figure 2:
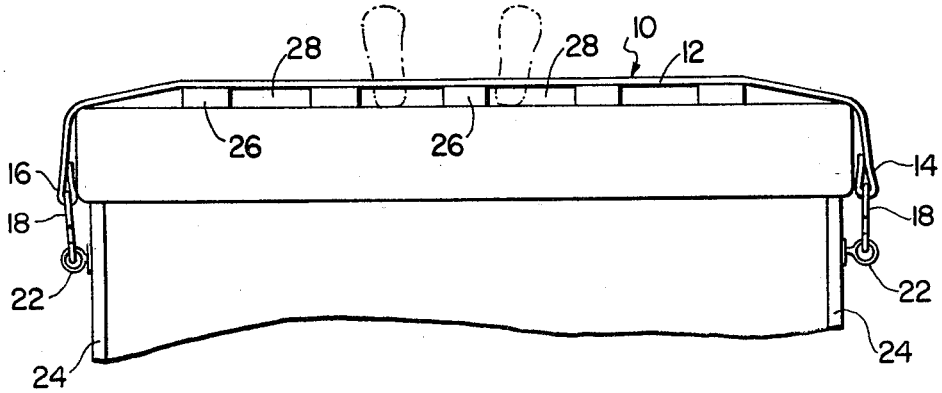
FIG. 2 is an end view of the strap, showing the manner in which it is attached to the bed frame, with the feet of the patient being shown partially in dashed lines.
Figure 3:
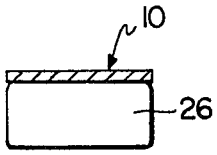
FIG. 3 is a sectional view taken on line 3—3 of FIG. 1.

Referring now in more detail to the application drawing, wherein like parts are indicated by like reference numerals, and initially to the form of the invention illustrated in FIGS. 1–3, the foot supporting strap in accordance with this form of the invention is generally flat, and of web-like construction. The strap can be made of textile, nylon or other suitable durable material, and can be made from a flexible material if desired. The strap is of sufficient length that the body portion 12 thereof extends entirely across the width of the bed, as shown in FIG. 2. Each end 14 and 16 of the strap is bent over to form a loop, with the free ends being secured to the strap so that the loops thus formed are permanent.

Fastener hooks commonly designated at 18 are secured to the ends of the strap, through the loops 16, as shown in FIG. 1. Each hook includes a flexible arm 20 which can be resiliently pressed inwardly of the hook to permit the same to be attached to eyelets designated at 22 secured to the frame 24 of the bed relatively adjacent the foot thereof. It will be understood that the length of the strap is such that the strap is reasonably taut when the fastening hooks are secured to the eyelets 22 as shown in FIG. 2. Alternatively, the strap can be formed with straight ends having openings through which a turn bolt can extend for threaded connection with a nut positioned adjacent the frame. If desired, the bolt and nut can be constructed and arranged for increasing the tension on the strap as the bolt is tightened.

Wedge members commonly designated at 26 are secured to the underside of the strap 10, by bonding or the like, and are spaced longitudinally along the strap as shown in FIGS. 1 and 2. Adjacent wedges thus define with the underside of the strap and the top of the mattress, or coverings therefor, a generally rectangular space 28. The wedges or blocks 26 can be formed of any suitable material, for example, foam rubber, polyurethane, or other generally soft or rigid materials. However, the wedges or blocks must be sufficiently firm to prevent the web from approaching contact with the mattress, which position would make it very difficult to accomplish the basic objectives of the supporting arrangement. Although more than two wedges are shown in FIG. 2, a pair of wedges could be provided, spaced relatively adjacent the edges of the mattress. It will be noted that the wedges could comprise materials such as sponge rubber or polyurethane wrapped in a moisture-proof wrapper to facilitate ease of cleaning the strap assembly and thus maintaining sanitary conditions. Likewise, the belt can be made of material which is inherently self-cleaning, or, alternatively, wrapped in a moisture-proof casing. In either of these events, the wedges or blocks are secured to the underside of the strap.

In the normal use of the foot supporting strap, the ends of the strap are secured to the eyelets 20 through the fastening hooks 18. As noted, the length of the strap is such that when the strap is fastened as shown, it is reasonably taut thereby to provide a brace against which the feet of the patient can engage and push to reposition the patient to a comfortable position. To accomplish this, the toes of the patient are positioned in spaces 28 between adjacent wedges and the feet extended until the arch of each foot engages the underside of the strap. Using the strap as a brace or a surface against which force can be applied, the patient then moves his body backwardly until a comfortable position is assumed. It will be understood that at the initiation of movement, the knees of the patient may be substantially bent due to the sliding of the patient toward the foot of the bed, particularly when the head section of the bed is elevated as above described. This is a normal position for reading, viewing television, and receiving visitations, and it is extremely difficult for the patient to maintain a sitting position without undergoing some movement toward the foot of the bed. With the knees thus flexed, force supplied by the feet to to the strap permits the body to be moved toward the head of the bed.

Once a comfortable position has been assumed, the patient can remove his feet from the strap, or maintain his toes loosely in the spaces 28 for possible further movement. Since the mattress is resilient, it is possible for the patient to extend his entire foot through the openings 28, by compressing the mattress, and FIG. 2 of the application drawing illustrates the feet of the patient in such position. However, it will be understood that in such position the patient has lost the ability to reposition his body unless and until the feet are withdrawn form the openings 28 and the procedures above described again undertaken.

It will be seen that the invention is of particular advantage for patients whose arms and back may be immobile. Normally, hospital beds are provided with side bars which can be grasped by the patient to reposition his body, but if the arms are immobile this method of repositioning is precluded. Likewise, with back ailments movement is severely restricted in terms of lifting one portion of the body relative to the other due to the stress placed on the back. By permitting movement of the body with the feet in accordance with the present invention, the repositioning can be effected without the use of the arms or lifting of the body.

Figure 4:
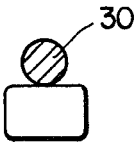
FIG. 4 shows a modified form of the invention in which the strap is generally cylindrical in cross section, with a wedge or block being shown attached to the strap.
Figure 5:
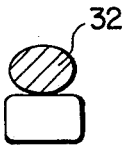
FIG. 5 is a view generally similar to FIG. 4, showing a further modification of the invention in which the strap is generally oval in cross section.
Figure 7:
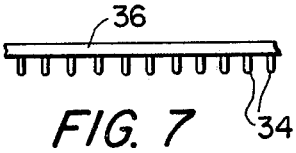
FIG. 7 illustrates another modification of the strap construction in which the strap is formed on the underside thereof with projections to enhance gripping of the strap.

The strap can take other forms than the flat form shown in FIGS. 1–3. Referring to FIGS. 4 and 5, for example, the strap may be generally cylindrical as shown at 30, or oval as shown at 32. FIG. 7 shows a further form of the strap in which a plurality of projections in the form of transverse webs 34 are provided which serve to space the strap 36 from the surface of the mattress. The webs 34 are resilient so as to permit the feet of the patient to be inserted beneath the same for repositioning of the patient as above described.

Figure 6:
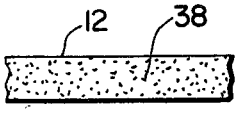
FIG. 6 is a fragmentary showing of a strap of a still further modified form of the invention in which the strap is formed with an anti-slip surface.

The strap 12 may be provided with an anti-slip surface 38 as shown in FIGS. 6, which facilitates the frictional engagement between the feet of the patient and the underside of the strap thereby to enhance repositioning of the patient.

Figure 8:
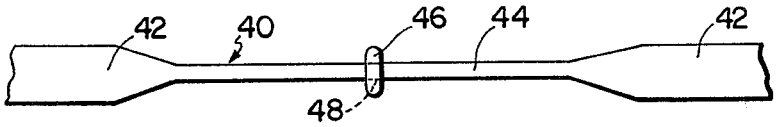
FIG. 8 shows a still further form of the invention in which the strap is of non-uniform configuration, and the wedge extends around an area of reduced dimension of the strap.

FIG. 8 shows a still further form of the invention in which the strap generally indicated at 40 includes wide, normally flat portions 42, and a narrow strap portion 44. The wide portions 42 prevent the strap from twisting. In the form shown, a generally circular wedge member 46 is positioned around the flat portion 44, with the member 46 being formed with a slot 48 through which the webbed portion 44 extends. The lower half of the wedge 46 thus performs in the same manner as the wedge members 26 in the FIGS. 1–3 form of the invention. Due to the slot 48, the wedge 54 can be positioned at any desired location along the narrow strap portion 44. It will be apparent that the wedge can also be in the shape of a ball. Also, a wedge or ball could be positioned around the wide strap portions 42, and suitably apertured as described. Flat wedges could also be provided, secured to the underside of the strap portions 42.

Although two or more wedges have been shown or described in all forms of the invention, a single wedge, as shown in FIG. 8 can be employed, provided that the wedge raises the strap sufficiently from the mattress or covering surface to permit the feet to engage under the strap, a critical feature in accordance with the invention.

I claim:

1. A foot supporting strap for beds comprising:

(a) a strap having a length longer than the width of the bed whereby the ends of the strap extend downwardly over the sides of the bed;

(b) fastening means secured respectively to the ends of said strap and the frame of said bed for detachably mounting said strap to said frame;

(c) means on the underside of said strap for spacing said strap from the mattress of the bed at two or more longitudinally spaced locations whereby in the regions adjacent said spacing means there is formed a space into which the feet of the patient can at least partially extend, said strap providing a brace against which the feet of the patient can push to permit movement of the patient to a more comfortable position.

2. The supporting strap of claim 1 wherein said fastening means comprise a fastening hook secured to each end of said strap and hook receiving members mounted on said bed frame, said fastening hooks being engaged through loops formed in the ends of said straps, the securing of said hooks to said bed frame serving to make said strap relatively taut.

3. The foot supporting strap of claim 1 wherein said spacing means comprise wedges secured on the underside of said strap in longitudinally spaced arrangement, the spacing of said wedges being such as to define spaces between the same and between said strap and the mattress for position adjustment.

4. The foot supporting strap of claim 1 wherein said strap is generally circular in cross-section, and said spacing means comprise a plurality of longitudinally spaced wedges secured to the underside of said strap.

5. The foot supporting strap of claim 1 wherein said strap is generally oval in cross-section, and said spacing means comprise a plurality of longitudinally spaced wedges secured to the underside of said strap.

6. The foot supporting strap of claim 1 wherein said strap is formed with at least one anti-slip surface.

7. The foot supporting strap of claim 1 wherein said spacing means on the underside of said strap comprise a plurality of longitudinally spaced and transversely extending ribs formed on and projecting downwardly from the underside of said strap, with said ribs serving to space said strap from the mattress, said ribs being sufficiently resilient to permit the feet of the patient to extend thereunder for position relocation.

8. The foot supporting strap of claim 1 wherein said strap is generally flat and formed of generally wide and generally narrow strap portions, said spacing means comprising a generally circular, slotted wedge member extending over said relatively narrow strap portion and serving to space said strap from the mattress.

* * * * *